US005186662A

United States Patent [19]

Yuasa et al.

[11] Patent Number: 5,186,662

[45] Date of Patent: Feb. 16, 1993

[54] DOUBLE LOCKING-TYPE ELECTRICAL CONNECTOR

[75] Inventors: Katsuhiko Yuasa, Ageo; Shinji Amemiya, Yokohama; Akira Nagamine, Kawasaki, all of Japan

[73] Assignee: AMP Incorporated, Harrisburg, Pa.

[21] Appl. No.: 871,884

[22] Filed: Apr. 21, 1992

Related U.S. Application Data

[63] Continuation-in-part of Ser. No. 706,684, May 29, 1991, abandoned.

[30] Foreign Application Priority Data

| | | | |
|---|---|---|---|
| May 30, 1990 | [JP] | Japan | 2-140348 |
| Dec. 27, 1991 | [JP] | Japan | 3-107594 |
| Apr. 3, 1992 | [JP] | Japan | 4-20119 |

[51] Int. Cl.[5] ..... H01R 13/514

[52] U.S. Cl. ..... 439/752; 439/595

[58] Field of Search ..... 439/595, 752

[56] References Cited

U.S. PATENT DOCUMENTS

| | | | |
|---|---|---|---|
| 4,045,110 | 8/1977 | Sterken | 339/91 |
| 4,284,320 | 8/1981 | Nix et al. | 339/200 |
| 4,758,182 | 7/1988 | Anbo et al. | 439/592 |
| 4,867,711 | 9/1989 | Yuasa | 439/752 |
| 5,037,336 | 8/1991 | Betsui | 439/752 |

FOREIGN PATENT DOCUMENTS

| | | | |
|---|---|---|---|
| 0384577A2 | 8/1990 | European Pat. Off. . | |
| 1-43986 | 9/1989 | Japan . | |
| 0183978 | 7/1990 | Japan | 439/752 |
| 2115625A | 9/1983 | United Kingdom . | |

*Primary Examiner*—Eugene F. Desmond
*Attorney, Agent, or Firm*—Adrian J. LaRue

[57] ABSTRACT

An electrical connector comprises an insulated housing (11) having contact-receiving chambers (10) formed by partitions (18) in which electrical contacts (30) are to be positioned; a locking member (13) having openings (16) formed by partitions (17); and latch means (20,21;22,23) on the housing (11) and the locking member (13) mounting the locking member in a first position on the housing (11) so that the partitions (17,18) are in alignment such that the spacing between the partitions is essentially eliminated thereby forming substantially continuous surfaces by the partitions enabling smooth insertion of the contacts (30) through the openings (16) and into the contact-receiving chambers (10).

12 Claims, 9 Drawing Sheets

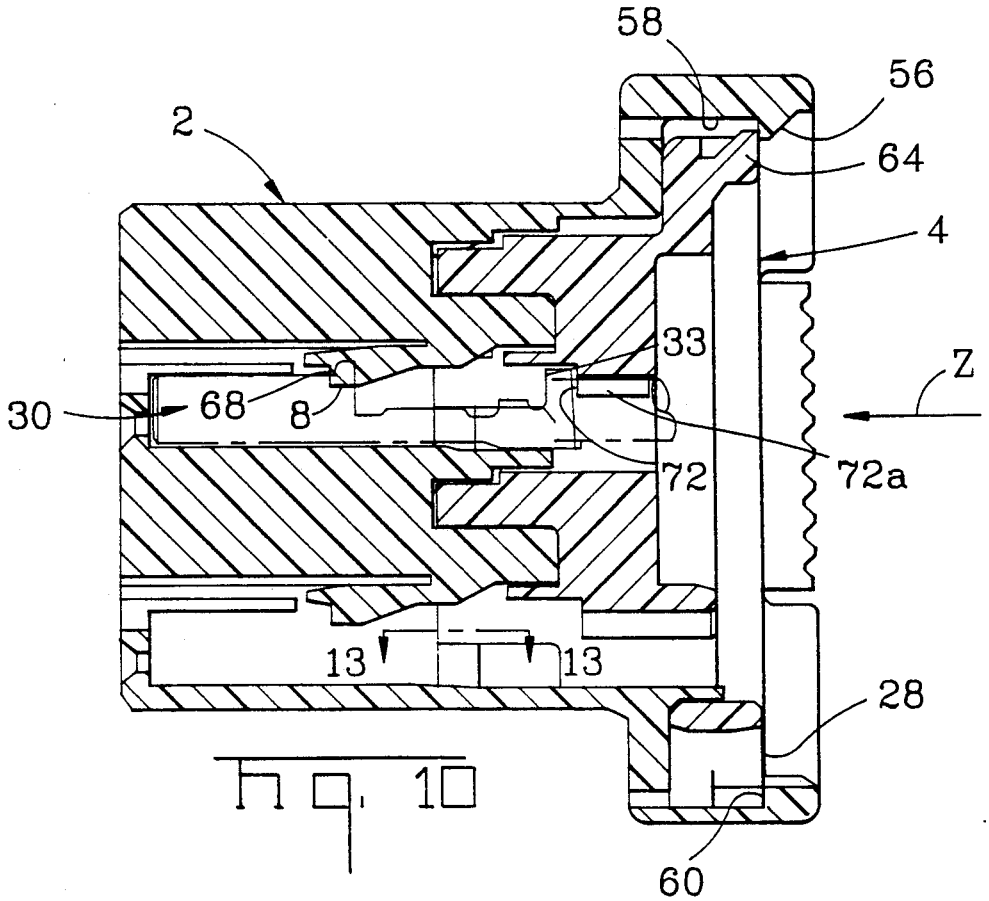
Fig. 10
Fig. 11
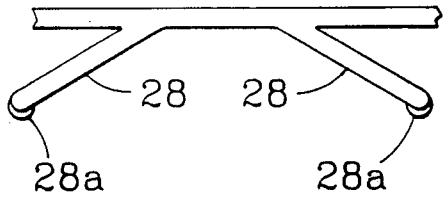
Fig. 12
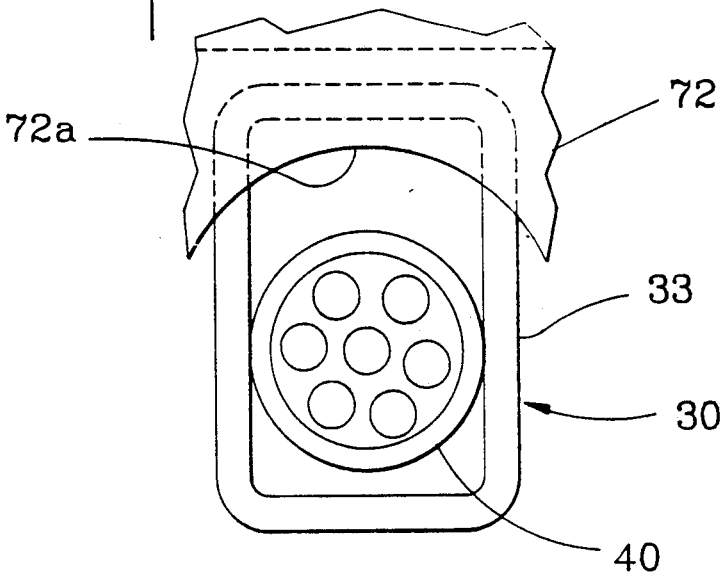
Fig. 13
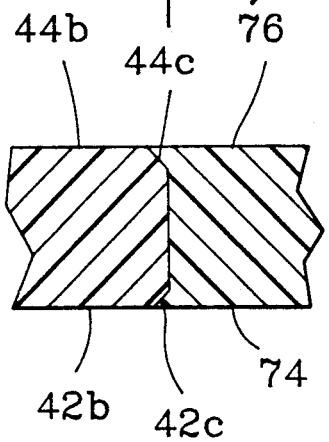

DOUBLE LOCKING-TYPE ELECTRICAL CONNECTOR

CROSS REFERENCE TO RELATED APPLICATION

This application is a continuation-in-part application of U.S. patent application Ser. No. 07/706,684 filed May 29, 1991, now abandoned.

FIELD OF THE INVENTION

The present invention relates to a double locking-type electrical connector and, in particular, to an electrical connector of the type which receives a double-locking member in the back end of the insulated housing which houses the electrical contacts reliably preventing the electrical contacts from coming out of the housing.

BACKGROUND OF THE INVENTION

There is a well-known double locking-type electrical connector in which a double-locking member is inserted from the back end of the housing as disclosed in Japanese Patent Publication No. 1-43986.

This type inserts a double-locking member from the back end of the housing and the locking action of the electrical contacts is a double locking which makes use of a housing lance and a locking action which makes use of a double-locking member. It is advantageous in that the electric contact-retaining force is reinforced and makes it possible to tell when the contact has not been inserted completely and presses in the electrical contact when it is not completely inserted.

However, in the above-mentioned type of double locking-type electrical connector, the multiple electrical contact housing chambers of the housing are separated and the double-locking member is separated by partitions which are arrayed at the same intervals as the above-mentioned partitions. When the electrical contact is housed in the above-mentioned electrical contact housing chamber, the partition on the above-mentioned housing and the partition of the double-locking member are arrayed on the same flat surface and are at the temporary locking position of the so-called double locking member. The electrical contact is guided by this into the chamber of the housing, is again guided along the chamber of the housing and is housed in the indicated contact housing chamber. Then, both of the above-mentioned partitions shift from a position where they are arrayed on the same flat surface as mentioned above and are positioned so that each of the partitions of the double-locking member fits in between each of the partitions of the housing and is set at the principal locking position of the double-locking member.

However, there were problems in the conventional double locking-type electrical connector described above in that, when the above-mentioned double-locking member was set in the temporary locking position, there was somewhat of a space between the partition of the housing and the partition of the double-locking member. Therefore, the front end of the electrical contact which was inserted made contact with the end part of the top side of the partition of the housing, the back end of this electrical contact was fitted into the above-mentioned space and the electrical contact was not inserted smoothly. In particular, there were a great number of electrical contacts inserted and the size of the electrical contacts decreased and at the same time the above-mentioned electrical contacts could no longer be inserted smoothly.

Another well known double-locking type electrical connector is disclosed in Japanese Utility Model Publication No. 3-106668, wherein the double-lock member is equipped with guide walls extending up and down in two directions from the contact insertion hole toward the forward direction thereby guiding the contact smoothly into the contact housing chamber.

Nevertheless, when inserting the contact, there are occasions when the contact is inserted inclined not just in the up or down direction but also in the left or right direction. Therefore, in the double-lock member which has the vertical guide walls, when the contact is inserted inclined left or right there is concern that the front end of the contact may engage with the rear end of the lateral partition forming the contact housing chamber, and it is difficult to say that the contact push-in operation has been adequately improved.

It is an object of the present invention to take into consideration these conditions and to provide a double locking-type electrical connector which can have inserted the electrical contacts smoothly in the electrical contact housing chambers of the connector housing in the temporary locking position of the double-locking member.

Another object of this invention, in view of the above noted situation, is to provide a double-lock-type electrical connector designed to improve the contact insertion operation b making it possible to smoothly insert a contact without colliding with the rear end of the contact accommodation chamber's partition.

SUMMARY OF THE INVENTION

The double locking-type electrical connector of the present invention has the following characteristics. In the double locking-type connector which is configured by positioning a double-locking member at the back end of an insulated housing which is equipped with multiple electrical contact housing chambers which are surrounded respectively by partitions with housing lances formed along partition walls, the partitions of the above-mentioned insulated housing and the partitions of the above-mentioned double-locking member are arrayed on the same flat surfaces and essentially eliminates the space between the partitions of the double-locking member and the partitions of the insulated housing at the temporary locking position of the above-mentioned double locking member which guide the electrical contacts into the above-mentioned electrical contact housing chambers.

Furthermore, the phrase "essentially eliminates" indicates reducing the space until it no longer adversely affects the electrical contacts being guided smoothly.

The above-mentioned configuration ensures that both partitions of the housing and the double-locking member have the same flat surfaces and that there is basically no space between them when the electrical contacts are inserted in the electrical contact housing chambers. As a result, the electrical contacts are guided by both of the above-mentioned partitions and at the same time they can be housed in the contact housing chambers smoothly without the electrical contacts being hung up between the housing and the double-locking member even if they are pressed into the electrical contact housing chambers.

In another embodiment of the present invention, a double-lock-type electrical connector is equipped with an insulated housing that has multiple contact housing chambers provided with locking units that lock contacts therein and which accommodates electrical contacts and which are formed by means of partitions which are orthogonal in all directions in the contact insertion direction, and a double-lock member is mounted at the rear end of the insulated housing so it can be moved from a first position at the rear end to a locking position and which has contact insertion holes corresponding to all of the previously noted contact housing chambers and which locks contacts accommodated in the previously noted contact housing chambers at the locking position, the double-lock-type electrical connector related to this conception is characterized by having guide walls formed in the previously noted double-lock member orthogonal in all directions to the contact insertion direction to guide contacts inserted at the previously noted first position through the contact insertion holes into the contact housing chambers without colliding with the partitions in any direction.

As noted above, in the double-lock-type electrical connector of this concept, the double-lock member is equipped with vertical and lateral guide walls that guide the contacts inserted at the first locking position through the contact insertion holes into the contact housing chambers so that they do not collide with the vertical and lateral partition rear ends of the contact housing chambers; therefore contacts are guided by these vertical and lateral guide walls and are inserted smoothly without colliding vertically or laterally with the rear ends of the partitions of the contact housing chambers, thereby resulting in a smooth contact insertion operation whereby the contacts do not engage any housing chamber edges.

BRIEF DESCRIPTION OF THE DRAWINGS

FIGS. 3A–3C are cross-sectional views of the connector showing the operation of the connector when an electrical contact is inserted in the contact housing chamber;

FIGS. 6–10 are cross-sectional views of the connector housing when an electrical contact is inserted in the contact housing chamber through a contact insertion hole of the double-locking member as seen from the direction of arrow X of FIG. 5.

FIG. 11 is a view of the spring legs of the double-locking member as seen from the direction of arrow Y of FIG. 6.

FIG. 12 is a fragmentary view of a double-locking section of the double-locking member in a double-locking position relative to the contact as seen from the direction of arrow Z of FIG. 10.

FIG. 13 is a cross-sectional view along the line 13—13 of FIG. 10.

DETAILED DESCRIPTION OF THE INVENTION

Figure 1:
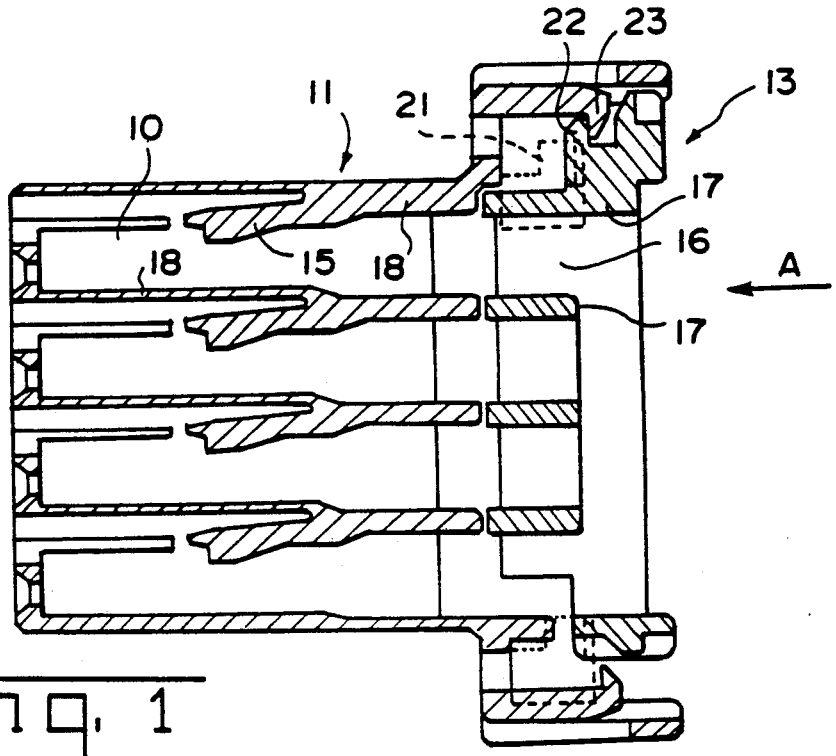
FIG. 1 is a cross-sectional view of the housing of the double locking-type electrical connector and the double-locking member.
Figure 2:
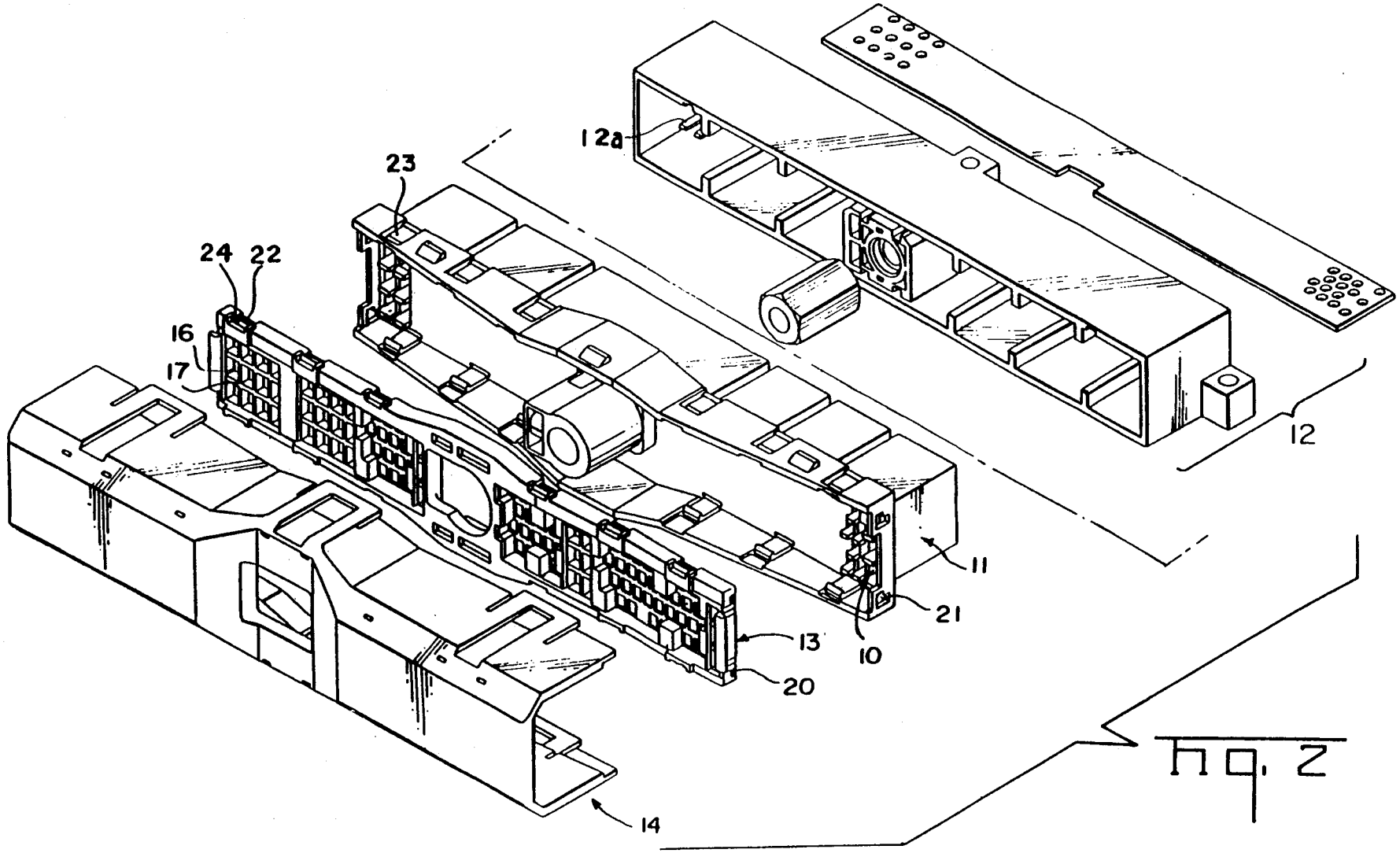
FIG. 2 is an exploded perspective view of the double locking-type electrical connector as well as the connector on the other side.
Figure 7A:
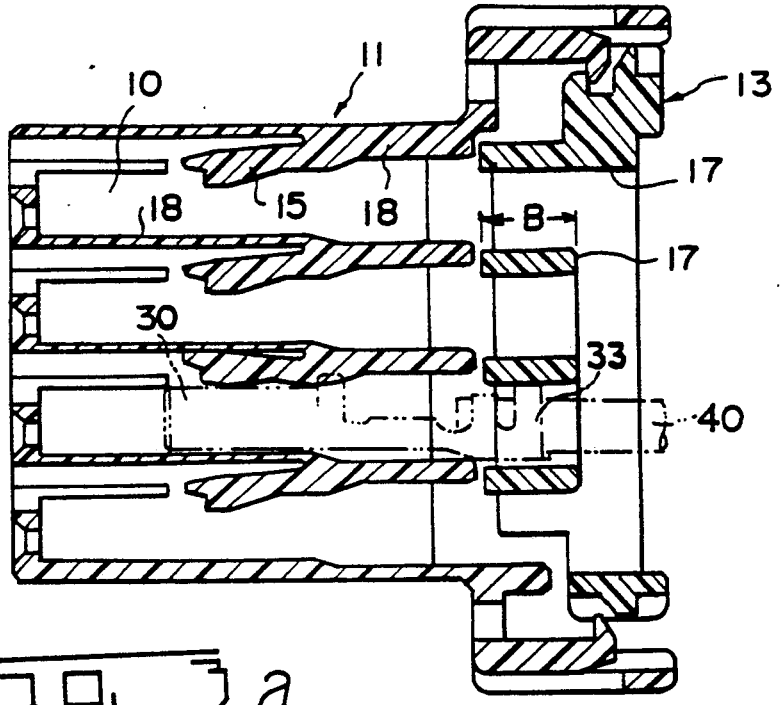
Figure 7B:
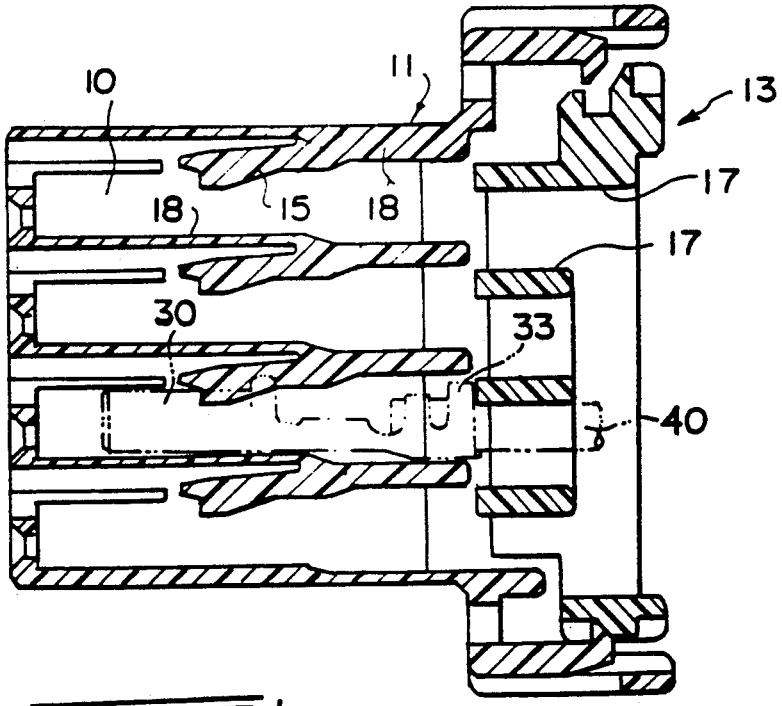
Figure 3C:
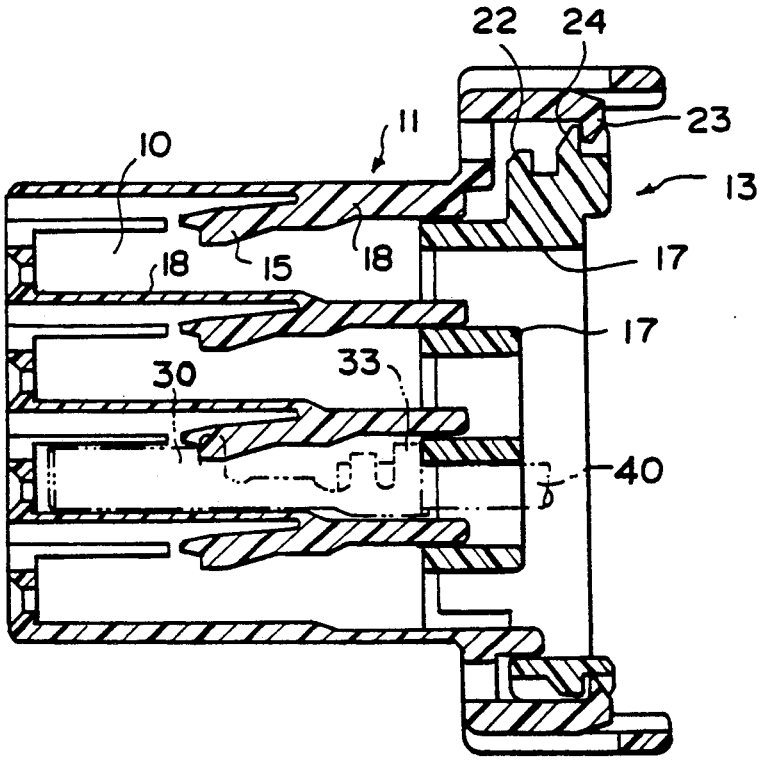

As FIG. 2 shows, the connector of the present invention is made up of an insulated housing 11 which is equipped with multiple electrical contact housing chambers 10 (most of them are omitted in the drawing), double-locking member 13 which is fitted to the back end of insulated housing 11 (the side which is opposite the surface which fits into the other insulated housing 11) and wire protector 14 which protects multiple wires 40 which are positioned between double-locking member 13 and latches onto insulated housing 11 and extends from insulated housing 11. Each of the electrical contact housing chambers 10 is partitioned off by each of the partitions 18 and a lance 15 which retains electrical contact 30 (the first locking) is formed along partition 18. The above-mentioned double-locking member 13 is equipped with openings 16 through which are inserted electrical contacts 30. Each of the openings 16 are partitioned to form an arc shape from partitions 17. In addition, the above-mentioned double-locking member 13 moves in the direction (the direction which intersects with arrow A in FIG. 1) which intersects with the axis of the above-mentioned electrical contacts then it can move in an axial direction (the direction of arrow A in FIG. 1) relative to the electrical contacts 30 which are disposed in the above-mentioned insulated housing 11 and retains (the second locking) electrical contacts 30 therein as indicated in FIG. 3C.

Figure 4:
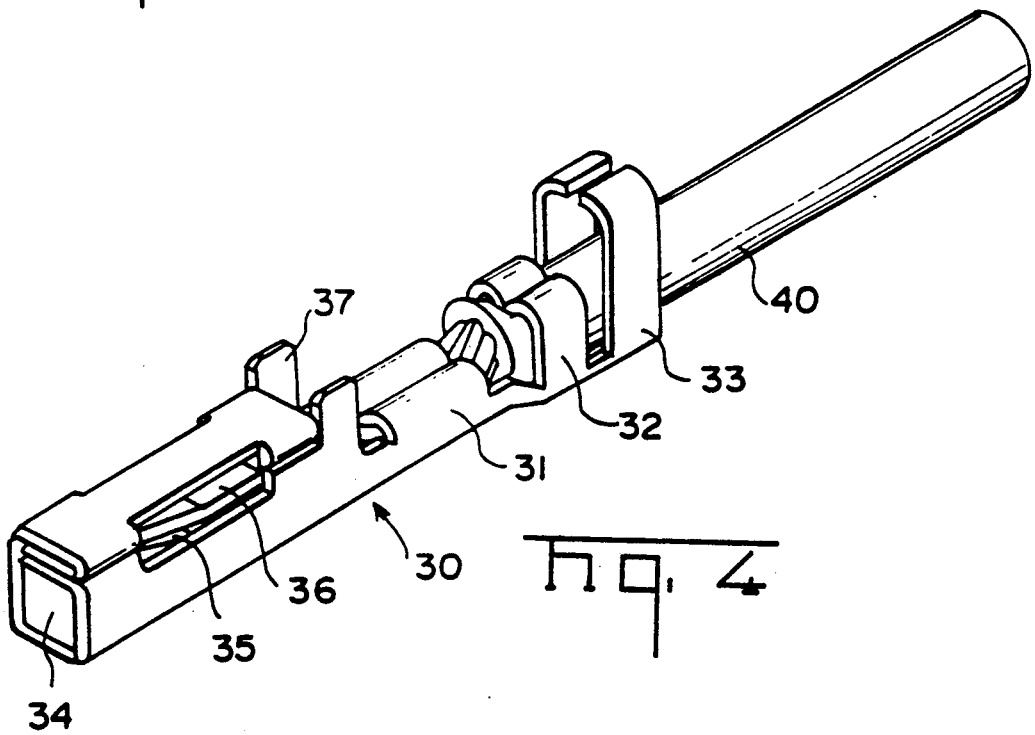
FIG. 4 is an enlarged perspective view of the electrical contact which is used in the connector.

The electrical contact 30 used in the practical example is formed as indicated in FIG. 4. It is equipped with a wire barrel 31 which is used to crimp and retain wire 40 securely, a double-locking barrel 33 which engages with the double-locking member 13, main spring 35 and auxiliary spring 36 which are used to engage the contact pin **12*a* on the other connector 12 which is inserted in the front end opening 34 and stabilizers 37 which stabilize the position of the electrical contact and to prevent electrical contact 30** from becoming misaligned.

Next, FIG. 1 and FIGS. 3A through 3C illustrate how the above-mentioned electrical contacts 30 are inserted into the above-mentioned insulated housing 11 through the above-mentioned double-locking member. First, the four locking parts on the double-locking member 13 are inserted in the temporary locking holes 21 on each end of the corresponding insulated housing 11 as a standard step which enables electrical contacts 30 to be inserted in the contact housing chambers 10. The first locking member 22 on the double-locking member 13 locks onto the locking pawl 23 of the insulated housing 11 and the double-locking member 13 is set at the temporary locking position. In this position, the partitions 18 of the insulated housing 11 and the partitions 17 of the double-locking member 13 are arrayed on the same flat surface and the electrical contacts 30 which are inserted through the openings 16 of the double-locking member 13 can be guided smoothly in the direction of arrow A. In the present invention, the partitions 18 of the insulated housing 11 also extend longer in the direction of double-locking member 13 than the conventional one. This makes the spaces between the corresponding partitions 17 and 18 in the temporary locking position extremely small. As a result, electrical contacts 30 can be inserted quite smoothly without any problems arising such as the front end making contact with the end part of the partitions 18 of the insulated housing 11 and the back end of the electrical contacts 30 becoming caught between both partitions 17 and 18 when the electrical contacts 30 are inserted. Length B of the partitions 17 of the double locking member 13 is reduced by approximately 50% compared to the conventional unit. This makes it possible to upgrade the operability when the double-locking member 13 is used. When there is a so-called "incompletely inserted electrical contact" as when insertion of the electrical contact 30 is stopped halfway in the condition indicated in FIG. 3A, the end surfaces of both partitions 17 and 18 make contact with each other since partition 17 makes contact with the double-locking barrel of the electrical contact 30 even if the double-locking member 13 is pushed in the direction of the arrow A and the double-locking member 13 is not inserted into housing 11 any further.

Next, when the double-locking barrel 33 of the electrical contact 30 passes through the partition 18 of the double-locking member 13, the double-locking member 13 is lowered only to the extent which corresponds to the thickness of this partition 18 relative to the insulated housing, as indicated in FIG. 3B.

Then, when the double-locking member 13 is pushed in the direction indicated by arrow A, the upper surface of the partitions 17 of the double-locking member 13 brushes against the lower surface of the partitions 18 of the insulated housing 11 as the double-locking member 13 is moved within the insulated housing 11. When this double-locking member 13 is shifted, the front end of the partitions 17 pushes the back end of the double-locking barrel 33 of the electrical contacts 30 and the electrical contacts 30 which are completely inserted in electrical contact housing chambers 10 as indicated in FIG. 3C. At this time, the locking pawl 23 of the insulated housing 11 locks onto a second locking 24 of the double-locking member 13 and the double-locking member is locked at the principal locking position.

The connector shown in FIGS. 5–10 is a male-type connector accommodating multiple contacts, and is made of insulated housing 2 and double-lock member 4. This male-type connector is moved in the engagement direction (direction of arrow A) in regard to a female-type connector equipped with multiple male contacts and not shown, and it engages with the female connector, whereby the female-type connector's male-type contacts and the male-type connector's female contacts are electrically connected.

The insulated housing 2 has multiple contact housing chambers 6; each contact housing chamber 6 is equipped with housing lance 8 which flexibly bends in the up and down directions and has its fixed end at the rear end of the engagement direction and its free end at the front end of the engagement direction; male-type contact insertion hole 50*a* is formed in wall 50 of the engagement direction's front end to extend into each of the contact housing chambers 6; and opening 54 is formed in the rear end of housing 2 to mount double-lock member 4 therein.

Locking projection 56, which extends within opening 54, is formed at the upper wall of the rear end of insulated housing 2. Space 58 is located adjacent to locking projection 56 and forward thereof. Step 60 is formed in the lower wall of the rear end of insulated housing 2, with the surface forward of step 60 being lower.

Contact insertion holes 52, which correspond to each of the contact housing chambers 6, are formed in the double-lock member 4. Locking projection 64 is formed at the upper end of double-lock member 4 with locking depression 66, which is adjacent to locking projection 64 and forward thereof. The bottom surface of the lower wall of double-lock member 4 is equipped with spring legs 28, as shown in FIG. 11, which is a view seen from the direction of arrow Y in FIG. 6; spring legs 28 slant downward and project outwardly with the upper ends as the base ends and the lower ends as the free ends; the legs 28 bend springably up and down in the diagram. Furthermore, downward-projecting large diameter sections 28*a* are formed at the free ends of spring legs 28.

Figure 5:
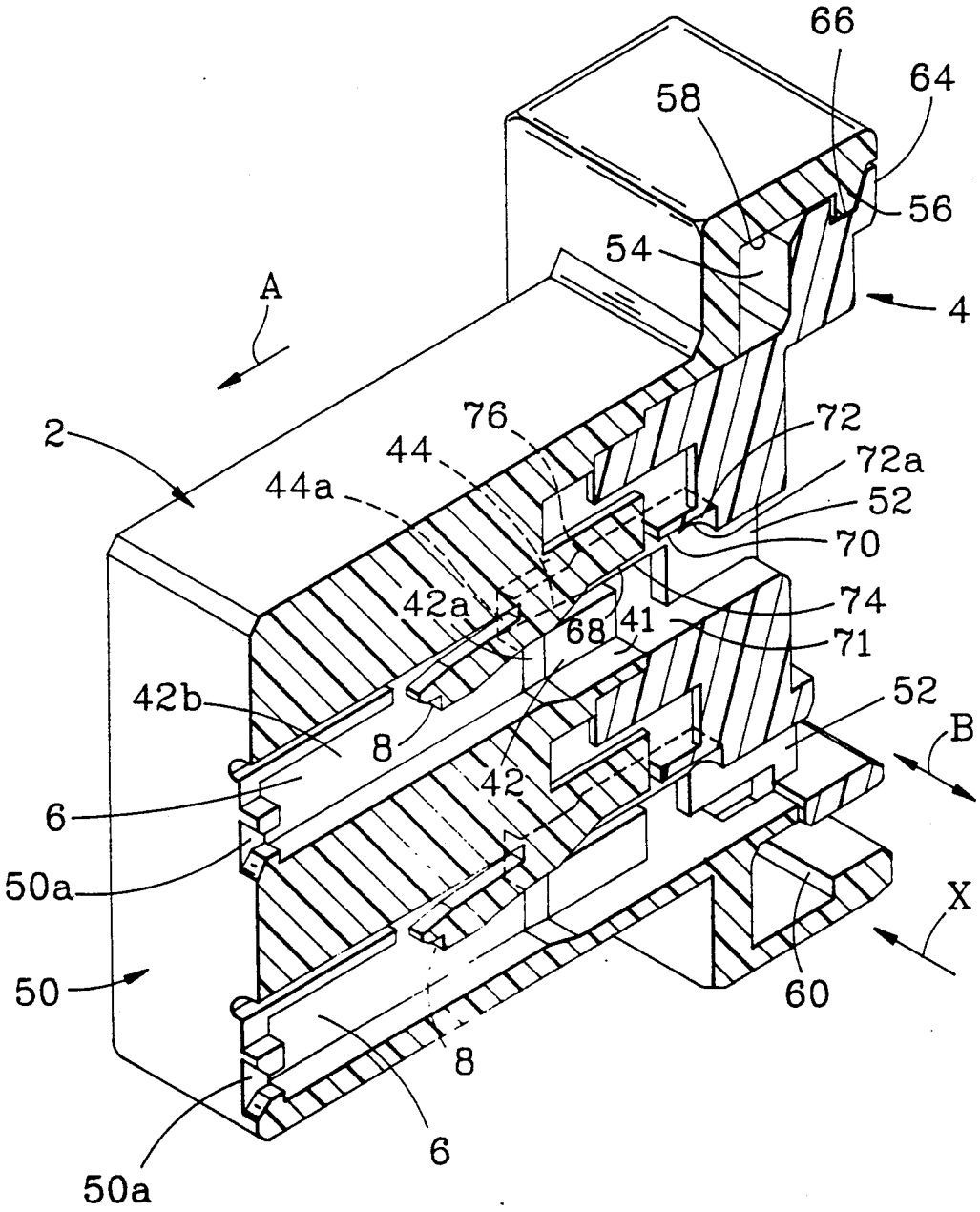
FIG. 5 is a perspective view in cross section of another embodiment of a housing of the double lock-type electrical connector with the double-locking member in a first position.
Figure 6:
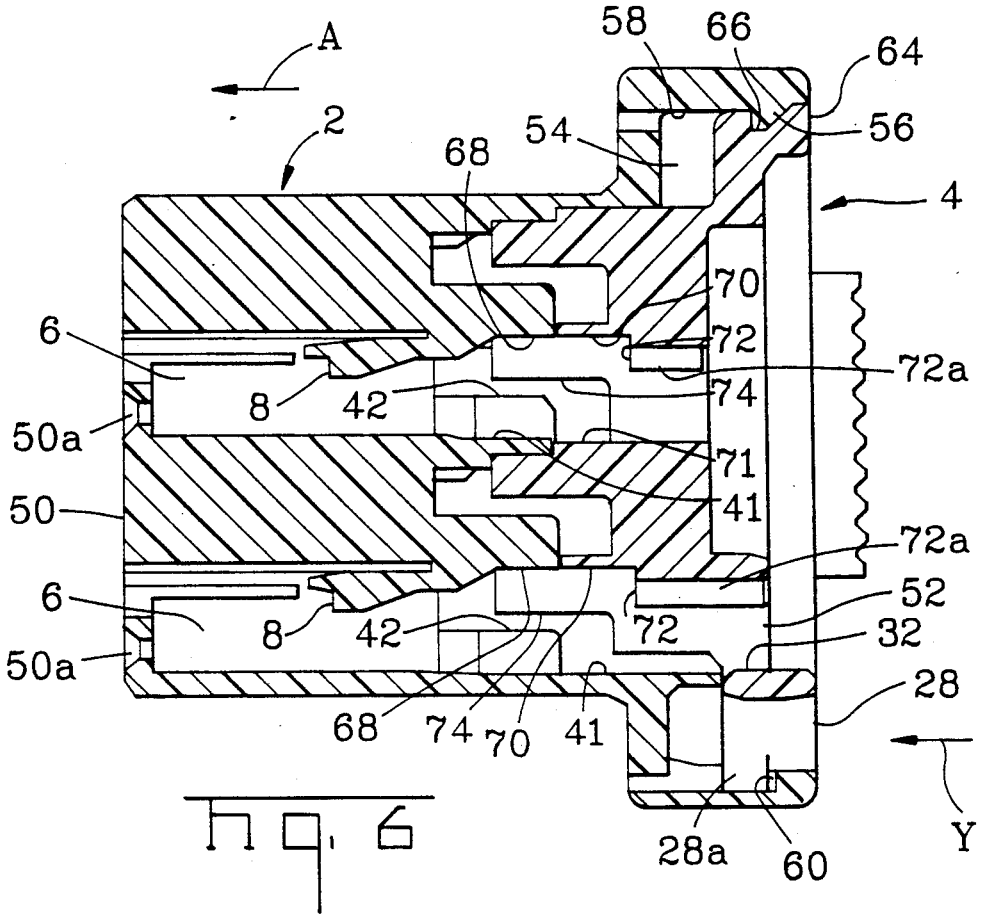

In the condition shown in FIGS. 5 and 6, locking projection 56 of housing 2 engages with the locking depression 66 of double-lock member 4 and the large diameter units 28*a* of spring legs 28 engage with the lower surface forward of step 60, thus double-lock member 4 is temporarily locked in opening 54 of the rear end of insulated housing 2 at a first position.

Also, upper guide wall 70, lower guide wall 71, left guide wall 74 and right guide wall 76 (which is formed in the same way as left guide wall 74; see FIG. 5 regarding right guide wall 76) are formed in double-lock member 4 extending from the contact insertion hole 52 and forward therefrom. These upper and lower and left and right guide walls 70, 71, 74, and 76 are formed so that when double-lock member 4 is at the temporary locking position, the contacts which are inserted through contact insertion holes 52 into contact housing chambers 6 are smoothly guided into the contact housing chambers 6 without colliding with the ends of rear end sections 68, 41, 42 and 44, which are the upper and lower and left and right partitions of contact housing chambers 6 (see FIG. 5 regarding the end of the right partition of rear end section 44).

Specifically, at the temporary locking position, the guide wall surfaces of upper guide wall 70 and lower guide wall 71 of double-lock member 4 are designed so that they are in the same plane as the rear end section 68 of the upper partition and the rear end section 41 of the lower partition, and the front ends of the upper and lower guide walls 70 and 71 touch or almost touch the ends of the upper and lower partition rear end sections 68 and 41. The left guide wall 74 and right guide wall 76 of the double-lock member 4 and the left partition rear section 42 and right partition rear section 44 are positioned so that they overlap above and below as shown in FIG. 5. The surfaces of left and right partition rear end sections 42 and 44 are positioned laterally outside the surface of the left lateral partition main body 42*b* (the right partition main body is not shown in FIG. 5) by means of taper sections 42*a* and 44*a* (as seen from the direction of arrow B, FIG. 5); meanwhile the guide surfaces of the above noted left and right guide walls 74 and 76 are in the same plane as the left and right partition main bodies 42*b*, and therefore are positioned laterally inside the surfaces of left and right partition's rear end sections 42 and 44.

Furthermore, as shown in FIG. 5, adjacent contact insertion hole left and right guide walls 74 and 76 are made up of the same wall members, and the left side surface and right side surface form the left guide wall and right guide wall, respectively. Also, neighboring contact housing chamber left and right partitions 42 and 44 are formed in the same way from the same wall members.

Explained next are the insertion of contact 30 and double locking.

Figure 7:
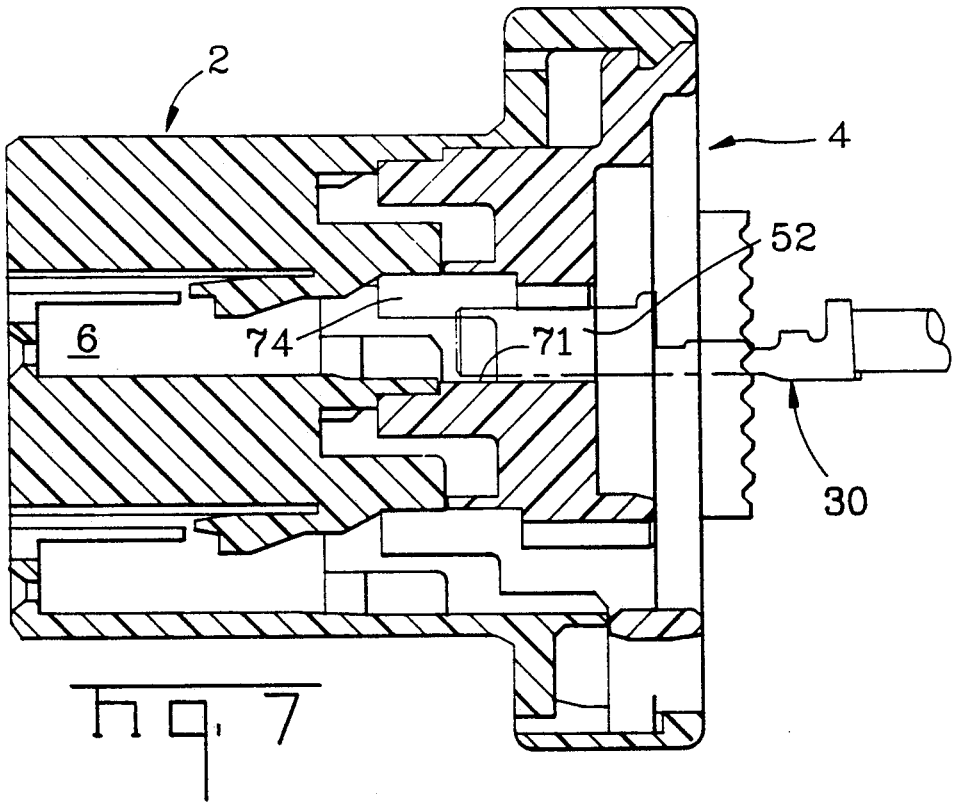

First, as shown in FIGS. 5 and 6, double-lock member 4 is temporarily locked in insulated housing 2. In this condition, as shown in FIG. 7, contact 30 is inserted into contact insertion hole 52. When this happens, contact 30 engages the double-lock member left and right guide walls 74 and 76 (right guide wall 76 is not shown in FIG. 7) and lower guide wall 71 and is guided into contact housing chamber 6.

Figure 8:
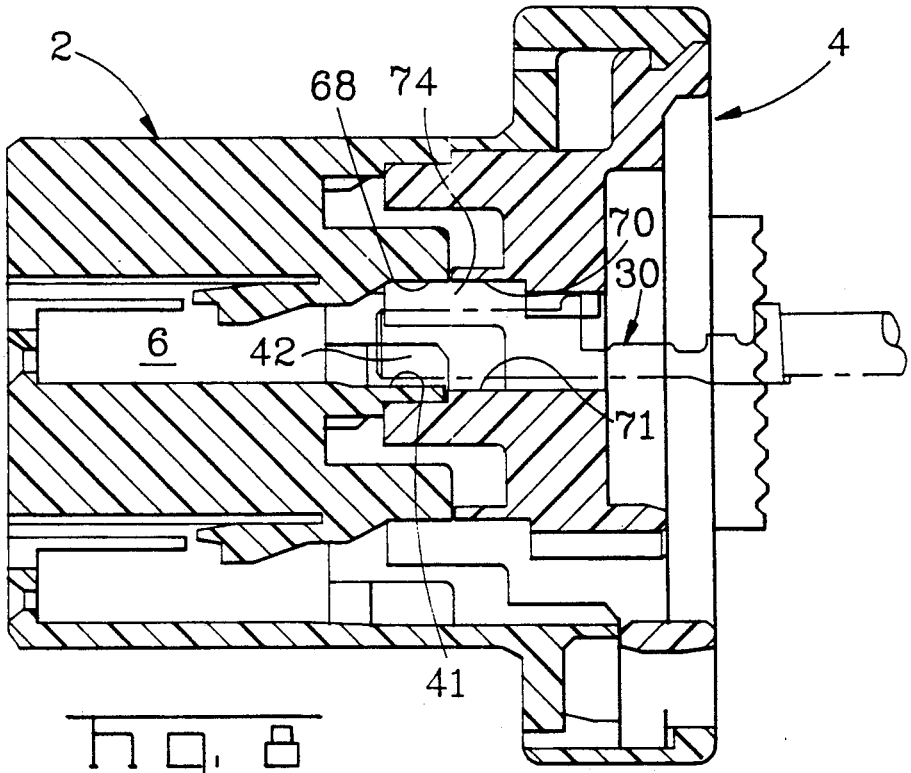

When contact 30 is further inserted from this position, as shown in FIG. 8, left and right guide walls 74 and 76 (right guide wall 76 is not shown in FIG. 8) overlap left and right partition rear end sections 42 and 44 (right partition rear end section 44 is not shown in FIG. 8) vertically for a specific length in the engagement direction, and the guide surfaces of left and right guide walls 34 and 36 are positioned further to the left and right than the surfaces of the left and right partition rear end sections 42 and 44, and the front ends of the upper and lower guide walls 70 and 71 engage the ends of upper and lower partition rear end sections 68 and 41 and are formed so that their surfaces are in the same plane, thus the front end of contact 30 is smoothly inserted into contact housing chamber 6 without colliding with the rear ends of the upper and lower and left and right partitions.

Figure 9:
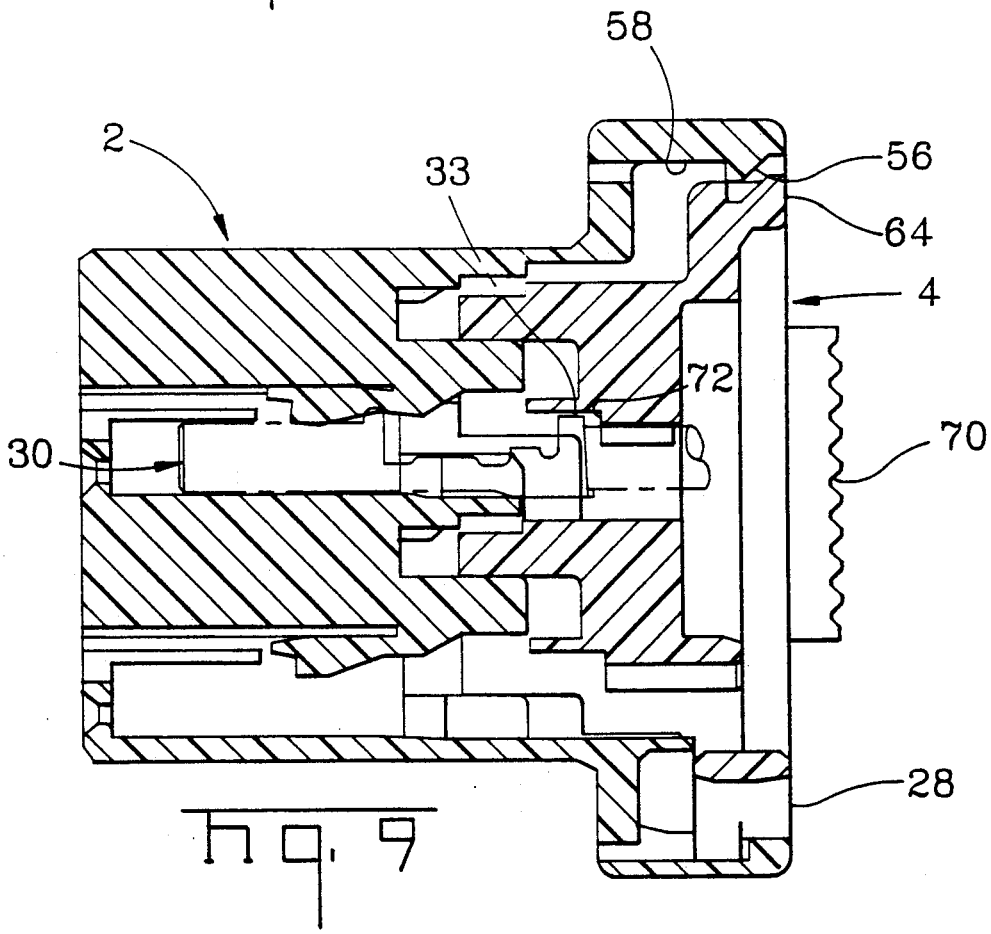

In this way, when double-lock member 4 is inserted to the position shown in FIG. 9 or the position shown in FIG. 10, operating section 80 of double-lock member 4 is pushed downward by hand. At the temporary locking position, double-lock member 4 is pushed upward by spring legs 28, and double-lock member 4 can be pushed downward by bending spring legs 28. Then downward-pushed double-lock member 4 is cammingly moved forward; and, when locking projection 64 moves over the locking projection 56 of housing 2, locking projection 64 fits into locking depression 58 and the outer ends of spring legs 28 engage with step 20, as shown in FIG. 10, and double-lock member 4 is truly locked in position in insulated housing 2.

As shown in FIGS. 5 and 6, downward projecting locking projections 72 are formed on the upper wall of contact insertion holes 52 of double-lock member 4; therefore, when the double-lock member 4 is pushed forward from the position shown in FIG. 9, wherein it is pushed downward from the temporary locking position, the front end of locking projection 72 comes into contact with the rear end of the double-lock barrel 33 and pushes contact 30 forward, and the contact is locked by the housing lance 8 at the true locking position shown in FIG. 10. In addition, double-lock barrel 33 is locked by the locking projection 72, and through this double locking the contact 30 is securely prevented from falling out.

Also, lower surface 72*a* of the locking projection 72 is formed in an arcuate shape as shown in FIG. 5 and in FIG. 12. Therefore the left and right ends of locking projection 72 extend downward more than the center unit, and ensure a wider contact area with double-lock barrel 3 compared to the underside of locking projection 72 being laterally horizontal; thus the effect o keeping the contact from falling out is improved. Furthermore, the shape of undersurface 72*a* can also be a U-shape with the front end open.

Furthermore, as shown in FIG. 13, which is a cross-sectional view along line 13—13 in FIG. 10, tapered surfaces 42*c* and 44*c* can be formed at the rear end of the contact housing chamber left and right partition surfaces 42*b* and 44*b*, and such rear ends and the front ends of the double-lock member left and right guide walls 74 and 76, which engage the rear ends, can have a concave/convex engagement configuration. By designing it in this way, one can expect a contact front end guide effect from tapered surfaces 42*c* and 44*c*, and the insulation distance between laterally disposed neighboring contact housing chambers can be increased.

Also, the embodiment described above was one in which double-lock member 4 is moved from the temporary locking position one step down and forward toward the true locking position, but this concept can be adopted in a double-lock-type electrical connector which is simply moved forward to the true locking position without going one step down. Also, as with the case of left and right guide walls 74 and 76, upper and lower guide walls 70 and 71 and lower partition rear end sections 68 and 41 can be made with a mutually complementing configuration (in this case, the configuration overlaps laterally). Furthermore, left and right guide walls 74 and 76 and left and right partition rear end sections 42 and 44 in the embodiment described above can have the opposite vertical position relationship.

As explained above, this conception's double-lock-type electrical connector forms vertical and lateral guide walls in the double-lock member to guide contacts into contact housing chambers so that contacts are smoothly inserted and guided by these vertical and lateral guide walls and do not collide with the contact housing chamber partitions laterally or vertically, and the contact insertion operation is substantially improved.

The present invention makes it possible to smoothly insert contacts into a double-lock-type electrical connector without colliding with the rear ends of the contact housing chamber partitions.

Double-lock member 4, which has contact insertion holes 22, is temporarily locked at the rear end of insulated housing 2, which has contact housing chambers 6. Upper and lower guide walls 70 and 71, which are on the same plane and engage the contact housing chamber upper and lower partition rear end sections 68 and 41, are provided at this temporary locking position in double-lock member 4. Left and right guide walls 74,76, which vertically overlap the contact housing chamber left and right partition rear end sections 42,44 and have a mutually complementary shape and are in the same plane as rear end sections 42, 44, are also provided at this temporary locking position in double-lock member 4, so that the contact 30 is guided by these left and right and upper and lower guide walls 70, 71, and 74,76 and is smoothly inserted into contact housing chamber 6.

Figure 14:
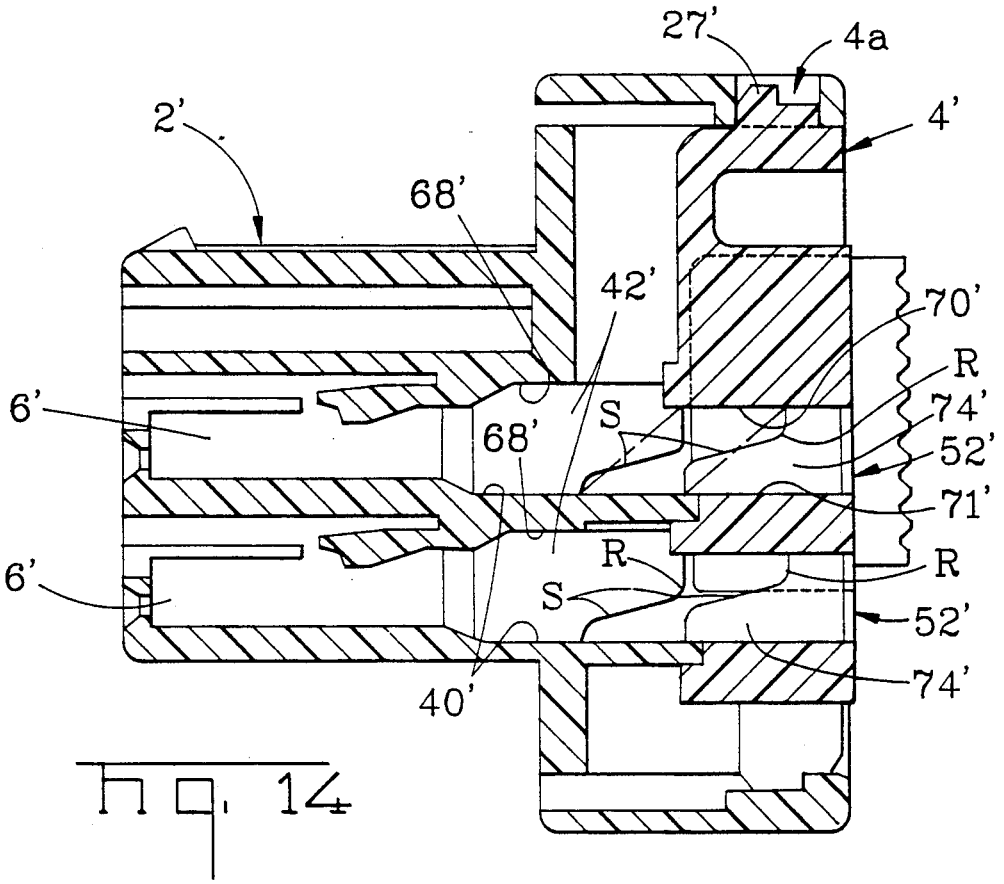
FIG. 14 is a cross-sectional view of a further embodiment of a housing of the double-locking type electrical connector showing the double-lock member at a first position.
Figure 15:
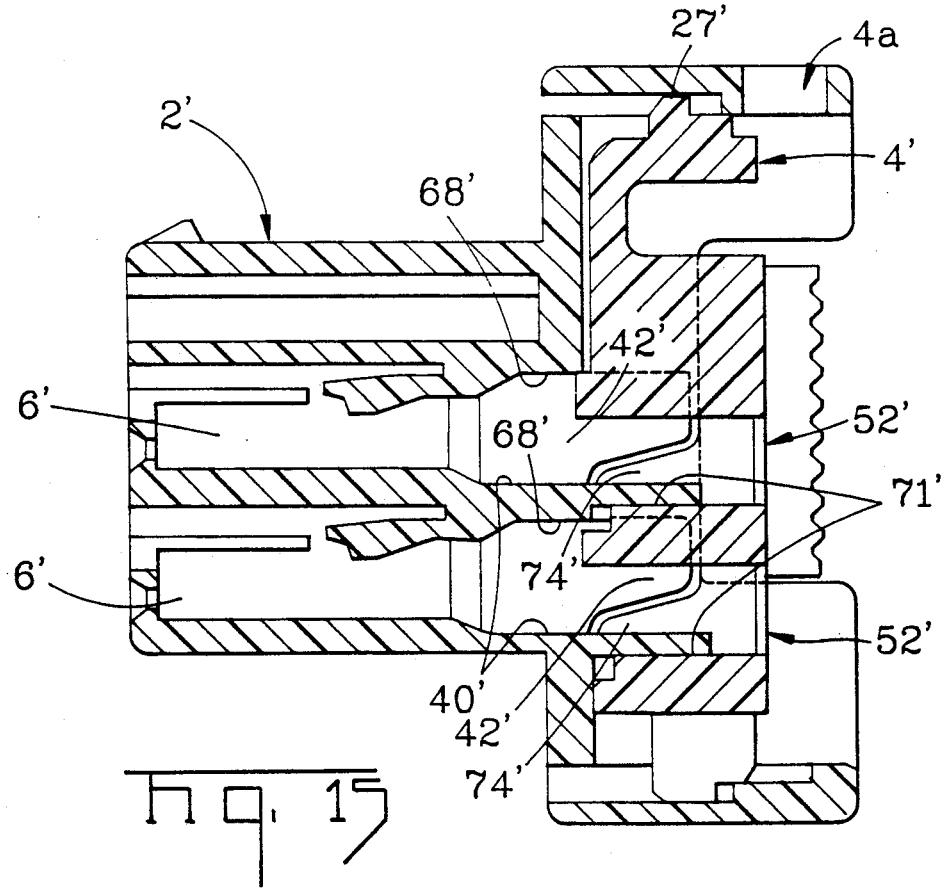
FIG. 15 is a view similar to FIG. 14 showing the double-lock member at a second or double-lock position.

FIGS. 14 and 15 are cross sectional views of a further embodiment of the double locking electrical connector according to the present device in a primary or first locking position and a final or secondary locking position, respectively. It is to be noted, however, that contacts are excluded in FIGS. 11 and 12. Reference numerals for the elements in FIGS. 14 and 15 corresponding to those in the embodiment of FIGS. 5 through 10 are omitted or the same reference numerals with primes are used regardless of slight differences. Only differences are described hereunder.

As illustrated in FIG. 14, the double locking member 4' is provisionally retained by the engagement of an engaging projection 27' of the double locking member 4' with an engaging hole 4a in insulating housing 2'. Pushing down and also in the mating direction (left in the drawing) the double locking member 4' with respect to the insulating housing 2' will bring them into the final locking condition as illustrated in FIG. 15.

Similarly to the above embodiment, the double locking member 4' in this embodiment is provided with an upper guide wall 70', a lower guide wall 71', a left guide wall 74' and a right guide wall (not shown) extending from each contact insertion hole 52' in the mating direction. It is to be noted here that the upper guide wall 70' is isolated from a rear end portion 68' of a contact housing chamber 6', but the upper guide wall 70', is lower than the rear end portion 68'. Accordingly, a contact (not shown) is guided to the rear end portion 68' without hitting the rear end portion 68' of the isolation wall. Also, the lower or bottom guide wall 71' is flush with a rear end portion 41' of the lower wall of the contact housing chamber 6' with no gap therebetween for smooth guiding of the contact at the lower end.

Although the complementary shape of the left guide wall 74' of the double locking member 4' and a rear end portion 42' of the left isolation wall of the insulating housing 2' is the same as in the other embodiment, they are in an upside-down relationship as compared with the other embodiment. This is true about the right guide and isolation walls that are not shown in the drawings.

Complementary slopes S are formed in the left guide wall 74' and the rear end portion 42' of the left isolation wall, thereby minimizing the gap therebetween for smooth insertion of the contact. This is particularly useful for automatic contact insertion. If the radius of curvature R of the left guide wall 74' and the rear end portion 42' of the left isolation wall is increased, the gap therebetween will be slightly increased but the vertical edge at the rear end of the rear end portion 42' of the left isolation wall will become shorter to reduce the chance that the contact front end hits the edge.

The edge portions at the front end of the left guide wall 74' and the rear end portion 42' of the left isolation wall may be slanted as illustrated by broken lines in FIG. 14. This may increase the gap between the left guide wall 74' and the rear end portion 42' of the left isolation wall but eliminates the vertical edge portions, thereby eliminating any possibility to hit such edge portions by the contact. The above description about the left guide wall 74' and the rear end portion 42' of the left isolation wall is also applicable to the right guide wall and the rear end portion of the right isolation wall which are not shown in FIGS. 14 and 15.

In each of the two embodiments, the double locking member 4,4' is a type to be first pushed down and then forward from the provisional, primary or first locking position to the final or second locking position. However, it is to be understood that the present device is also applicable to a double locking electrical connector to transfer to the final locking position by simply moving forward the double locking member 4,4'. The upper and lower guide walls and the rear end portions of the upper and lower isolation walls may be of a complementary form similar to the right and left guide walls overlapping at right and left sides in this case.

The double locking-type electrical connector of the present invention is not limited to the practical example described above and a variety of modifications of it are possible. For example, the partitions of the insulated housing are not extended in the direction of the double locking member farther than the conventional unit and the partitions of the double-locking member may be extended in the direction of the insulated housing.

If the double locking-type electrical connector of the present invention is used, the space between both the partitions in the insulated housing and the double-locking member is essentially eliminated so that the electrical contacts can be inserted quite smoothly in the electrical contact housing chambers in the temporary locking position of the double-locking member.

We claim:

1. An electrical connector housing, comprising:

a dielectric housing member having partitions forming a plurality of contact-receiving chambers extending from a front end to a contact insertion end of said housing for receiving electrical contacts therein;

a dielectric contact-locking member having further partitions defining a plurality of holes extending therethrough corresponding to that of the contact-receiving chambers;

first latch means provided by said housing member and said contact-locking member mounting said contact-locking member at a first position on the contact insertion end of said housing member with the housing partitions and the locking member partitions being in alignment such that the spacing between the partitions is essentially eliminated thereby forming substantially continuous surfaces by the partitions enabling smooth insertion of the electrical contacts through the locking member holes into the contact-receiving chambers; and second latch means including guide means for guiding said locking member as it moves to a second position causing upper sections of the locking member partitions to move from their aligned positions with the housing partitions and then along upper sections of the housing member partitions for engaging outer ends of the electrical contacts to maintain them in the contact-receiving chambers and said second latch means maintaining the locking member at said second position.

2. An electrical connector housing as claimed in claim 1, wherein housing lances extend from said housing partitions for engagement with the contacts when they are fully positioned in the contact-receiving chambers.

3. An electrical connector housing as claimed in claim 1, wherein said upper sections of the locking member partitions include locking projections for engaging double-lock barrel sections of the electrical contacts.

4. An electrical connector housing as claimed in claim 1, wherein said first latch means comprise interengaging latching members on said housing member and said locking member that include matable cam surfaces.

5. An electrical connector housing as claimed in claim 4, wherein said locking member includes spring legs extending outwardly from a bottom surface of said locking member which engage an inner surface of said housing member.

6. An electrical connector housing for securing electrical contacts therein, comprising:

a dielectric housing member having partitions forming a plurality of contact-receiving chambers extending along said housing member for receiving the electrical contacts therein;

a dielectric locking member having further partitions defining a plurality of holes extending therethrough;

first latch members provided by said housing member and said locking member mounting said locking member at a first position at one end of said housing member with the housing member partitions and the locking member partitions being in alignment so that upper and lower rear end sections of said housing member partitions and upper and lower front end sections of said locking member partitions are adjacent each other so that the opposing surfaces of the rear end sections and the front end sections form substantially continuous surfaces enabling smooth insertion of the electrical contacts through the locking member holes into the contact-receiving chambers without colliding with the partitions; and second latch members provided by said housing member and said locking member for latching said locking member at a second position on said housing member whereby the upper front end sections of the locking member partitions are disposed under the upper rear end sections of the housing member partitions with contact-engaging sections of said locking member engaging the electrical contacts when positioned in said contact-receiving chambers thereby securing the contacts therein.

7. An electrical connector housing as claimed in claim 6, wherein said first latch members include upper and lower interengaging elements with one thereof having spring legs.

8. An electrical connector housing as claimed in claim 6, wherein said second latch members include upper and lower interengaging elements with one thereof having spring legs.

9. An electrical connector housing as claimed in claim 6, wherein housing lances extend from said housing member partitions for engagement with the contacts when they are fully positioned in the contact-receiving chambers.

10. An electrical connector housing as claimed in claim 6, wherein the lower rear end sections of said housing member partitions and the lower front end sections of the locking member partitions have overlapping parts.

11. An electrical connector housing as claimed in claim 6, wherein the side rear end sections of said housing member partitions and the side front end sections of the locking member partitions have tapered surfaces that interengage when the locking member is at said second position.

12. An electrical connector as claimed in claim 11 wherein the outermost ends of the side rear end sections of the housing member partitions and the innermost ends of the side front end sections of the locking member partitions are radiussed.

* * * * *